US005250154A

United States Patent [19]

Didier

[11] Patent Number: 5,250,154

[45] Date of Patent: Oct. 5, 1993

[54] QUICK-RELEASE POST FOR A PAPERMAKING MACHINE PRESS FRAME

[75] Inventor: James J. Didier, Beloit, Wis.

[73] Assignee: Beloit Technologies, Inc., Wilmington, Del.

[21] Appl. No.: 946,992

[22] Filed: Sep. 17, 1992

[51] Int. Cl.[5] ..... D21F 3/04

[52] U.S. Cl. ..... 162/273; 162/358.1

[58] Field of Search ..... 162/199, 272, 273, 358.1; 100/151, 173; 72/237, 238

[56] References Cited

U.S. PATENT DOCUMENTS

| | | | |
|---|---|---|---|
| 4,861,431 | 8/1989 | Törmänen | 162/273 |
| 4,949,634 | 8/1990 | Riddick | 100/118 |
| 5,032,228 | 7/1991 | Hirsimäki | 162/199 |
| 5,091,056 | 2/1992 | Autio | 162/360 |

FOREIGN PATENT DOCUMENTS 56456 4/1980 Finland .

*Primary Examiner*—W. Gary Jones
*Assistant Examiner*—Dean T. Nguyen
*Attorney, Agent, or Firm*—Dirk J. Veneman; Raymond W. Campbell; Gerald A. Mathews

[57] ABSTRACT

A quick-release post apparatus for a press comprises a pair of opposed, spaced post members with a pivoted link mounted in one post member and a pivoted swing arm mounted in the other post member. The link is movable between the opposed first and second post members. The swing arm includes a hook for engaging a rod in the link whereby the link compressively preloads the ends of the opposed first and second post members against a removable block, which is interposed between the opposed ends of the first and second post members. The post can thereby be quickly reconfigured between an open position permitting passage between the first and second post members when the block is removed, and a closed position when the block is in place between the post members where the post is a rigid, load-bearing member.

8 Claims, 3 Drawing Sheets

QUICK-RELEASE POST FOR A PAPERMAKING MACHINE PRESS FRAME

BACKGROUND OF THE INVENTION

1. Field of the Invention

This invention relates to a post for a press, such as a roll press couple in a papermaking machine. More particularly, this invention relates to a load-bearing post having a removable section which permits passage of a looped member, such as a papermaking machine felt, through the space vacated by the removable section between the inner and outer sides of the post. Still more particularly, this invention relates to a quick-release apparatus for a vertical post wherein the post can be quickly configured between an open position, to permit passage of a looped member through the post, to a closed position where the post becomes a rigid, load-bearing structure.

2. Description of the Prior Art

In papermaking machines, and in some other pressing equipment utilizing looped members which need to pass through the press, there is a need for a frame support structure which can both withstand the tensile stress induced in the vertical posts by the opposed pressing members pushing against one another on either side of the support structure and which can also be opened, at least on one side, to permit lateral insertion and removal of a looped or otherwise continuous member, such as a papermaking felt in the press.

In a papermaking machine press, the press members typically comprise either a pair of co-rotating rolls nipped together or a single rotating roll which bears against a so-called shoe having a concave face conforming to the cylindrical surface of the roll. In both such papermaking machine press sections, one or two water-absorbing felts and possibly a fabric or water-impervious blanket also pass through the nip between either the co-rotating rolls or the roll and shoe. The felts are disposed on one or both sides of the paper web to absorb water expressed from the paper web by the nip. The configuration using a roll nipped with a shoe is known in the papermaking industry as an extended nip, or wide nip, type press. In an extended nip type of press, a water impervious blanket also passes through the nip to provide a surface which does not move relative to the paper web or felt interposed between the blanket and paper web. The other side of the blanket is lubricated so as to facilitate its passage over the surface of the shoe which pressures the felts, paper web and blanket against the surface of the rotating roll.

In all of these papermaking press configurations, the felts and blanket are typically endless loops, which must be brought into, and out of, operating position over the face of the roll as an integral piece which requires that they be moved over the ends of the rolls or, in the case of an extended nip type of press, the shoe. This requires that a section of the press frame be removed to permit the felt, belt or blanket to be inserted without breaking its loop.

Prior such framework requires the use of a crane to hold the upper part of the frame when its removable section is removed to permit the looped felt, belt or blanket to be inserted transversely across the width of the machine in the direction of the roll axis of rotation. Such a configuration is utilized in a so-called free-standing frame for an extended nip type press.

Another prior art press frame configuration utilizes a massive, fixedly mounted overhead beam from which links hang down on which the lower press roll member is mounted. At the bottom of the parallel, downwardly extending link members, a removable base frame member is attached and spaced from the floor. The base frame member can then be supported relative to the floor and lifted slightly to permit the links to be pivoted upwardly out of the way so the looped felt or other member can be positioned in the space between the rolls forming the press couple.

In typical prior press configurations of structural framework having removable sections for permitting passage of flexible, looped web processing members into and out of the press, the removable sections are held in place by swing bolts which pivot from either side of the span of the removable section. In some prior configurations, so-called shear plates are bolted to opposed sides of a vertical post component of the framework such that one or more key-like members are held between the post and a contiguous shear plate to maintain rigidity and permit the post to be put under tension.

As the speeds and nip loads of papermaking machines increase, the tensile strength of the swing bolts and shear plate arrangements are not adequate to maintain the beam members containing the removable sections pressed together tight enough to provide the required rigidity and structural integrity to maintain the strength, alignment and resistance to vibration required during operation. In some cases, a single large so-called hydraulic bolt, which utilizes a hydraulically actuated nut, has been implanted in the press post and special retraction means are required to move the bolt to permit the removable section to be removed. In other cases, shear plates are used to carry the high tensile loads, but such shear plates require more space, are time consuming to remove and are difficult to pre-load.

SUMMARY OF THE INVENTION

In this invention, a relatively small link is pivotally mounted in a first post member, which is in opposed end-to-end array to another post member with a space between them. The second post member has a slot to permit the link to rotate to a vertical position spanning the space between the vertically extending post members.

Pivotally mounted within the second post member is a swing arm having a hook for receiving a rod in the link. The swing arm also has a lever for moving the hook into, and out of, engagement with the rod. A spacer block is positioned in the space between the post members and is slotted such that the link can be pivoted into place between the post members while the spacer block is in position.

The swing arm lever provides a relatively large mechanical advantage to engage the link rod with the hook and produce a pre-load compressive force by the ends of the post members against the spacer block. The pre-load force on the link is produced when the swing arm rotates the hook downwardly in a substantially longitudinal direction relative to the post members and link. Since the cross-sectional area of the hook portion of the swing arm is relatively large and approximates about half of the cross-sectional area of the post members, it can provide a substantial tensile force on the link to pre-load the spacer block. Also, since the swing arm lever extending from the swing arm pivot is relatively long compared to the distance between the swing arm pivot and the hook, the eye bolts anchoring the swing arm to its post member have a large mechanical advantage and are not required to be made of any special high-strength alloy and do not require the use of special nuts, such as hydraulic nuts.

Due to the leverage of the swing arm and the relatively large cross-sectional areas of the link and hook, the pre-load compressive force established by the swing arm and link against the spacer block can be made much greater than the tensile force exerted on the posts in the opposite direction by operation of the press. The pivot pin for the link is securely mounted in the first beam member, and the pivot pin for the swing arm is securely mounted in the second beam member. The length of the link between its pivot pin and rod at the other end is also fixed. The dimension between the center of rotation of the swing arm to the center of the hook receiving the rod on the link is selected such that the force of the lever securing the swing arm into position by its mounting bolts produces a compressive force of the opposed ends of the post members against the spacer block which is in excess of the predetermined tensile force of the press in operation on the post members in the opposite direction. Most of the load and forces between the post members is thus taken up by the link and swing arm pivot pins and the link rod. A minor portion of the load and forces may be taken up by the lever eye bolts, depending on the configuration. From a practical standpoint, the end of the lever might bend slightly when secured against its eye bolt mounting to ensure that the hook/rod contact produces tension in the link.

This insures that the first and second post members combine with the spacer block to produce a composite post which has structural rigidity, integrity and maintains the post under tension during operation of the press and papermaking machine.

Since the bolts securing the lever in operating position do not directly take up the tensile load produced in the posts on either side of the press, they do not need to be of any special high-strength alloy, nor do they require special nuts to secure them in place. The lever bolts and lever provide a means to enable the swing arm to quickly release the hook over the link rod to permit removal of the spacer block between the post members.

The press framework in a papermaking machine of this invention preferably utilizes a cantilevered arrangement where the vertical post, or posts, on the back side of the papermaking machine are used to support a horizontal beam member, or structure, which is attached to the upper vertical post member forming part of the quick-release apparatus. When the spacer block forming the removable section in the post is to be removed, the swing arm lever is released. The cantilever force acts to urge the upper post member slightly upwardly to release the compressive force on the spacer block, thereby facilitating its removal.

Accordingly, it is an object of this invention to provide an improved apparatus for compressively securing a spacer block in a post of a press and for quickly releasing the compressive load on the post.

Another object of this invention is to provide a post frame arrangement for a papermaking press having a post with a removable section wherein a pre-load compressive force in the post with the removable section is provided by a pivoted link operating in conjunction with a pivoted swing arm.

Still another object of this invention is to provide a quick-release apparatus in a substantially vertical post in a papermaking machine press which permits the post to be under tension force during press operation while maintaining structural rigidity in the post.

A feature and advantage of this invention is that it avoids the use of hydraulic nuts.

Another feature and advantage of this invention is that it avoids the use of shear plates.

These, and other objects, features and advantages of this invention will become readily apparent to those skilled in the art upon reading the description of the preferred embodiment in conjunction with the figures.

DESCRIPTION OF THE PREFERRED EMBODIMENT

Figure 2:
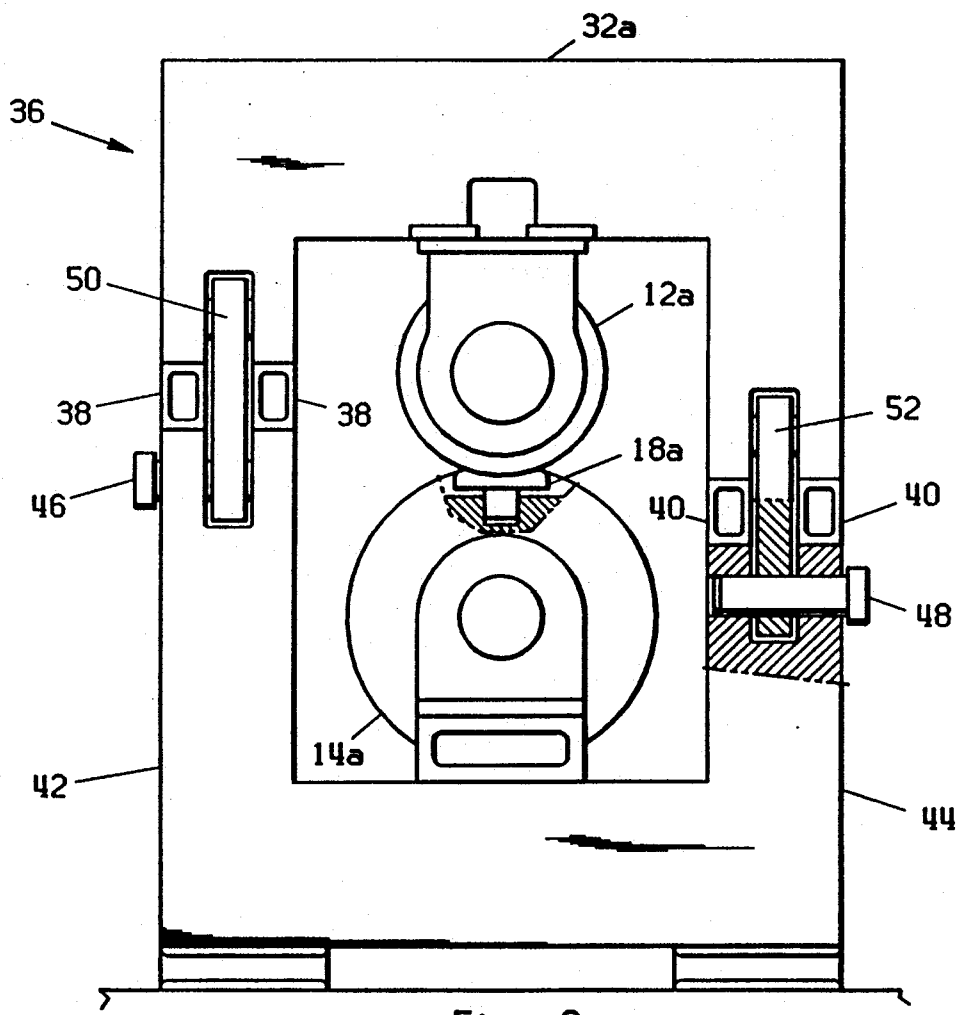
Fig. 2 ( Prior Art )
FIG. 2 is an end-elevational view of a prior art type of free-standing frame for an extended nip type of papermaking machine press and showing removable sections in both vertical posts of the frame.
Figure 1:
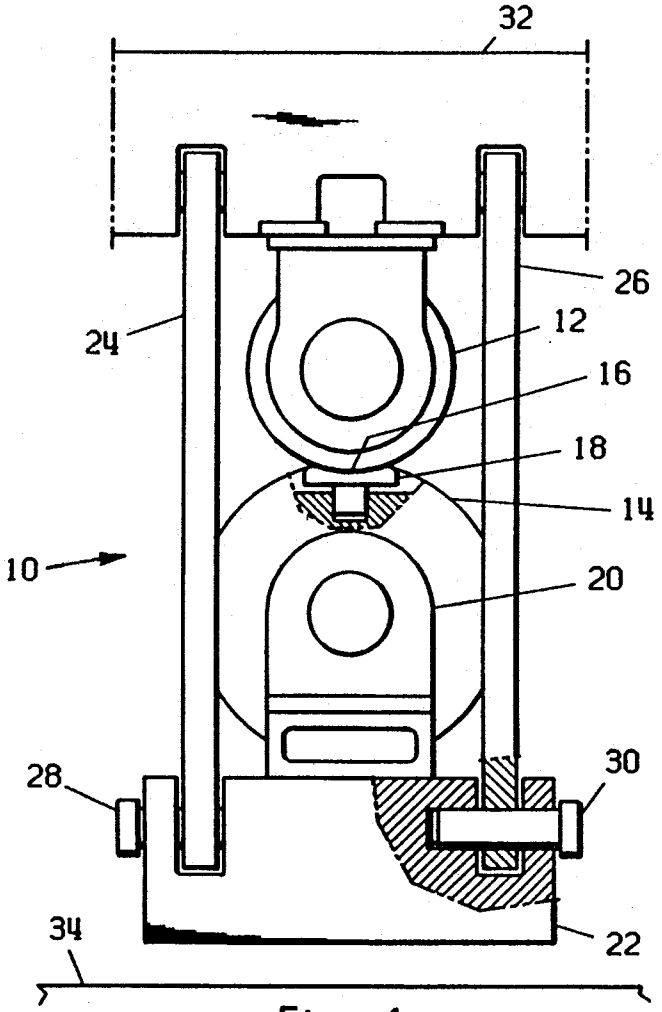
Fig. 1 ( Prior Art )
FIG. 1 is an end-elevational view of a prior art type of free-link suspension which does not utilize a removable section of a vertical post.

FIGS. 1 and 2 show two embodiments of prior art types of frames for papermaking machine presses. In FIG. 1, a free-link type of press frame, generally designated with numeral 10, has an extended-nip type of press with an upper press roll 12 in nipping engagement with a flexible, looped rubber blanket 14, which is disposed over the concave surface 16 of a shoe 18. The shoe is mounted in a shaft, or support, one end of which is shown at 20 and which extends laterally across the width of the papermaking machine. The end support 20 is, in turn, supported at either end on a beam 22 which is attached to a pair of vertically disposed free links 24,26 with pins 28,30, respectively. The free links function as posts which are mounted at their upper ends in a beam 32. These free links 24,26 derive their freedom from the fact that beam 22 is not mounted into either any of the framework of the papermaking machine or the floor 34. Thus, the free links are under tension when the extended-nip press shoe 18 is actuated to provide nip pressure against the backing roll 12, which, in turn, is secured against upward movement by the beam 32.

Such a free-link arrangement is not very stable structurally due to its lower end being unsecured. While each of the free links can withstand high tensile stress, the blanket and felts used in the pressing operation can be changed only by supporting press support beam 22 on the floor and pivoting each of the free links upwardly about their upper ends pivoted in beam 32. This is time consuming and requires a crane or some other kind of lift to support the free links.

In the description of the various apparatus, where possible and convenient, corresponding elements will be designated with the same numeral with different alphabet suffixes to distinguish them.

In the prior art embodiment shown in FIG. 2, a so-called free-standing extended nip press frame 36 is shown, wherein removable blocks 38,40 are located in both of the vertical posts 42,44 in the press framework. In this configuration, when the press is not in operation, the vertical posts 42,44 are in compression instead of tension. When it is desired to change the felts and/or rubber blanket, or belt 14*a*, in the press, the pins 46,48 are removed, and links 50,52 are pivoted out of the way, and the blocks 38,40 are removed while the roll 12*a* is supported by beam 32*a* which, in turn, is supported by either a crane or by cantilevering beam 32*a*. While such a mounting works well, it is difficult to secure and maintain structural rigidity, integrity and alignment with such a pin/pivoted link arrangement, due to the required fits and tolerances involved between the structural elements, when the press is actuated and the vertical posts 42,44 are under tension.

In a papermaking machine press section, the press elements, which include rolls and extended nip press shoes, are mounted in framework on the sides of the machine. Usually, as shown in the arrangements in FIGS. 1 and 2, a vertical post 42,44 is disposed laterally of either end of a roll or press arrangement at each end of the roll at each side of the papermaking machine. Thus, while the discussion of the preferred embodiment of the quick-release post of this invention will only be with regard to one such vertical post, it is to be understood that such an arrangement could be in one or more of the posts in a press section framework.

Figure 4B:
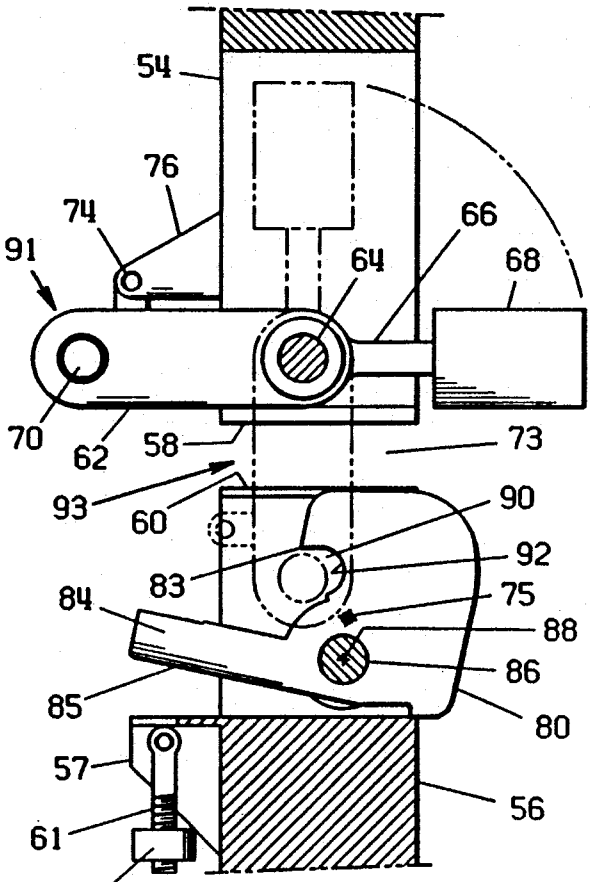
FIG. 4B is a side-elevational view of the quick-release post for this invention showing the swing arm and lever pivoted in disengaged position with the spacer block removed.
Figure 4A:
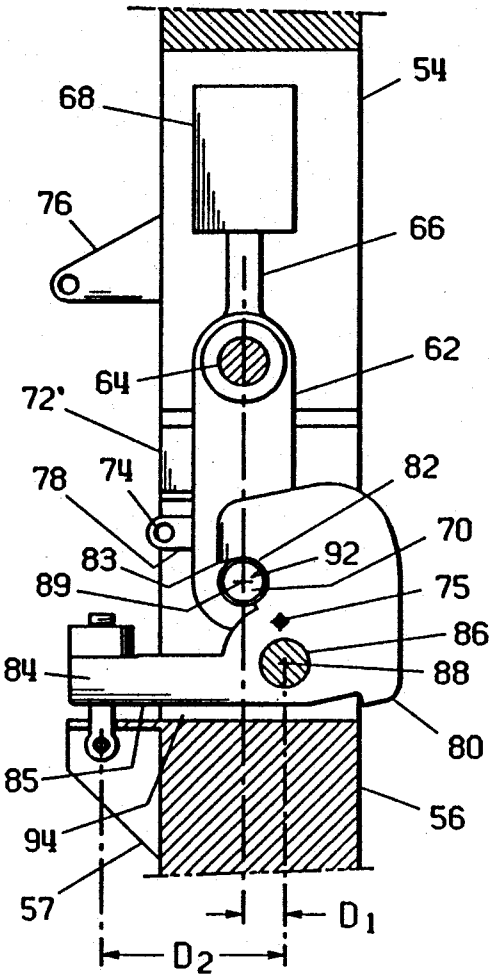
FIG. 4A is a side-elevational view of the quick-release post for this invention as shown in FIG. 3.
Figure 3:
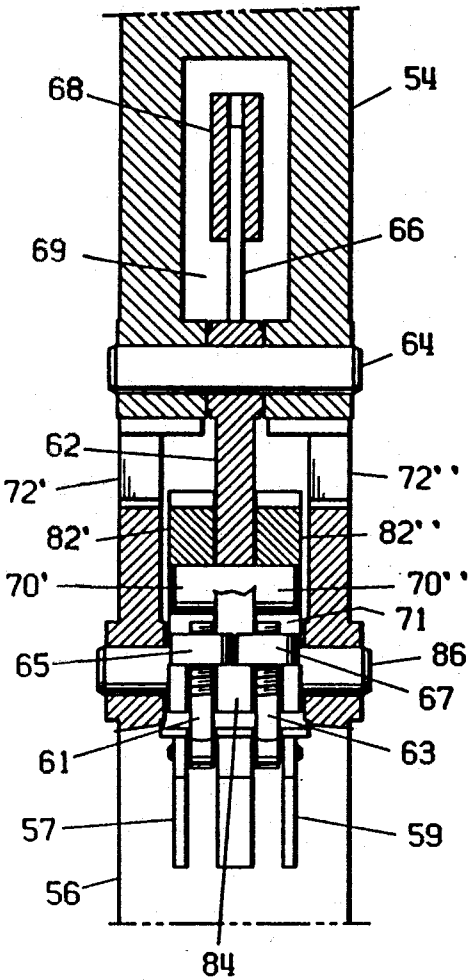
FIG. 3 is an end-elevational view, partially in section, of the quick-release post for this invention showing the swing arm hook engaging the link rod.

As shown in FIGS. 3, 4A and 4B, the structural vertical posts, which include the quick-release apparatus, in the press framework of this invention include upper and lower post members 54,56 which are aligned vertically in longitudinally extending, end abutting array and have opposed load ends 58,60 (FIG. 4B).

With reference to FIGS. 3 and 4B, the upper post member 54 has a link 62 pivotally mounted near the center of the post to rotate substantially in a vertical plane about a substantially horizontally disposed pin 64 mounted in the post member walls and which extends across a centered slot 69 in the end of the upper post member. Extending from one end of the link is an arm 66 on which a counterweight 68 is secured and capable of being adjusted longitudinally along the length of the arm. The link 62 extends from the pivot pin 64 in a direction opposite to that of the arm. At the distal end of the link is a rod 70 which extends laterally from each side of the link in a direction substantially parallel with the link pivot pin 64. When the link is pivoted out of position, such as when the post is separated with its spacer blocks 72', 72", removed to permit a felt to be passed between the post members 54,56, it can be secured into a disengaged position by inserting a pin 74 between a bracket 76 mounted to the upper post member and a flange 78 mounted on the link.

In the lower post member 56, a swing arm, generally designated with the numeral 80, includes a hook 82 and a lever 84 which extend from a pivot pin 86, which is mounted in the post member walls on either side of a centered slot 71 in the end of the lower post member 56 about an axis 88 which is substantially horizontal and parallel with the link pivot pin 64. Slots 69,71 are aligned in their respective post members such that the link may swing freely between them. The hook includes a pair of parallel, spaced hook members 82',82" which each include a cavity 90 having a curved surface 92 which matches the curvature of the rod segments 70',70" extending from either side of the link. The end of the hook 82 extends away from the hook cavity so as to permit engagement of the cavity surface 92 with the surface of the rod segment on either side of the link when the tip of the hook is below the top of the rod when the swing arm is pivoted to its operating, or engaged, position, as shown in FIG. 4A.

The lower post member 56 has a pair of flanges 57,59 in which eye bolts 61,63 are pivotally mounted such that, when the swing arm is rotated downwardly into position where the hook engages the link rods, the eye bolts can be rotated upwardly into a substantially vertical position where the nuts 65,67 on the ends of the eye bolts engage the lever to secure it into position with the hook engaging the rod on the link.

As shown in FIG. 4A, when the pivot arm is in its rod-engaging position, there is a space 94 between the lower surface 85 of the lever 84 and the lower post member 56. In this engaged position, the tip 83 of the hook has rotated slightly downwardly relative to the upper surface of the rod so as to induce some tension in the link.

As shown in FIG. 3, the removable section of the post comprises one or more blocks 72',72" which are mounted to engage the opposed load ends of the upper and lower post members 54,56. These load ends are preferably flat, parallel surfaces which are horizontally disposed when the post members are vertically aligned. However, it is contemplated that, for example, the surfaces of the load ends could be curved as long as their curvature matched the curvature of the corresponding surfaces of the removable block, or blocks.

In operation, to provide a structurally rigid post which maintains its alignment and which can withstand the vibration encountered during the operation of a papermaking machine, the blocks 72',72" are inserted in the gap 73 between the load ends of the opposed upper and lower post members. The pin 74 is released from the link 62 which, due to the counter-balance, is easily moved downwardly from its non-engaged position 91 to its operating, or engaged, position 93 shown in FIG. 4B. With continued reference to FIG. 4B, the swing arm 80 is then rotated counter-clockwise about its pivot 86 such that the hook members engage the corresponding rods to pull the link downwardly to have the load ends of the post members compressively engage the blocks. When the cavity surfaces of the hook members have substantially conformed to the curvature of the cylindrical rods, and the swing arm lever is substantially horizontal, such as shown in FIG. 4A, the eye bolts are swung upwardly into position in notches in the lever, and the nuts 65,67 are tightened. Due to the mechanical advantage provided by the distance between the center axis 88 of the swing arm pivot pin and the end of the swing arm at the eye bolts to the distance from the swing arm pivot pin to the center of the hook cavity, movement of the swing arm into operating position with the hook engaging the rods is relatively easy. Further, since the horizontal distance $D^1$, with reference to FIG. 4A, between the center of the swing arm pivot pin 86 and the center 89 of the link rod is less than the horizontal distance $D_2$ between the center 88 of the pivot pin and the eye bolts 61,63, the tension force transferred to the eye bolts is relatively small in order to maintain the desired compressive force between the hook 82 and rod 70.

The swing arm is also counter-balanced by virtue of its shape and mounting configuration. When the swing arm is in its closed position with the rod engaged, the center of gravity 75 of the hook 80 (FIG. 4A) is located slightly toward the lever, as measured from a vertical plane extending through the swing arm pivot pin center axis 88. This means that only a small upward force on the end of the lever is required to rotate the center of gravity angularly about axis 88 a relatively short distance (FIG. 4B) to the other side of axis 88, as measured from the same vertical plane through axis 88. This rotational movement also has the concurrent effect of releasing the hook cavity 90 from rod and facilitating further rotation of the hook clockwise, with reference to FIG. 4A. Angular rotation counter-clockwise (FIG. 4A) engages the hook and rod, while angular rotation clockwise (FIG. 4B) disengages the hook and rod. The hook and rod are thereby engaged and disengaged with relatively little force being applied for a relatively short distance. The structural integrity between the two longitudinally aligned post members can thus be quickly released and quickly engaged. The weight of the swing arm, acting through the center of gravity 75 about pivot pin 86, is effectively used to keep the hook in either the engaged or disengaged position.

Structural rigidity and load bearing capability is established and maintained by tension loading the link between its pivot in the upper post member and its rod secured relative to the lower post member such that the opposed load ends on the post members compressively bear against the spacer block, or blocks. This provides longitudinal rigidity along the abutted post members through the spacer block, or blocks. Torsional rigidity is established and maintained by the link pivot pin in the upper post; the rod between the link and the hook; and the swing arm pivot between the swing arm and the lower post.

The quick-release capability is provided by the release of the lever by the eye bolts via their nuts. The subsequent pivotal movement of the hook away from the rod quickly releases the link from the lower post. The counter-balanced link can then be easily secured in the top post by a pin through the bracket or the link and a flange on the upper post to permit passage of a felt or belt through the gap formed between the post load ends when the spacer block is removed.

Figure 5:
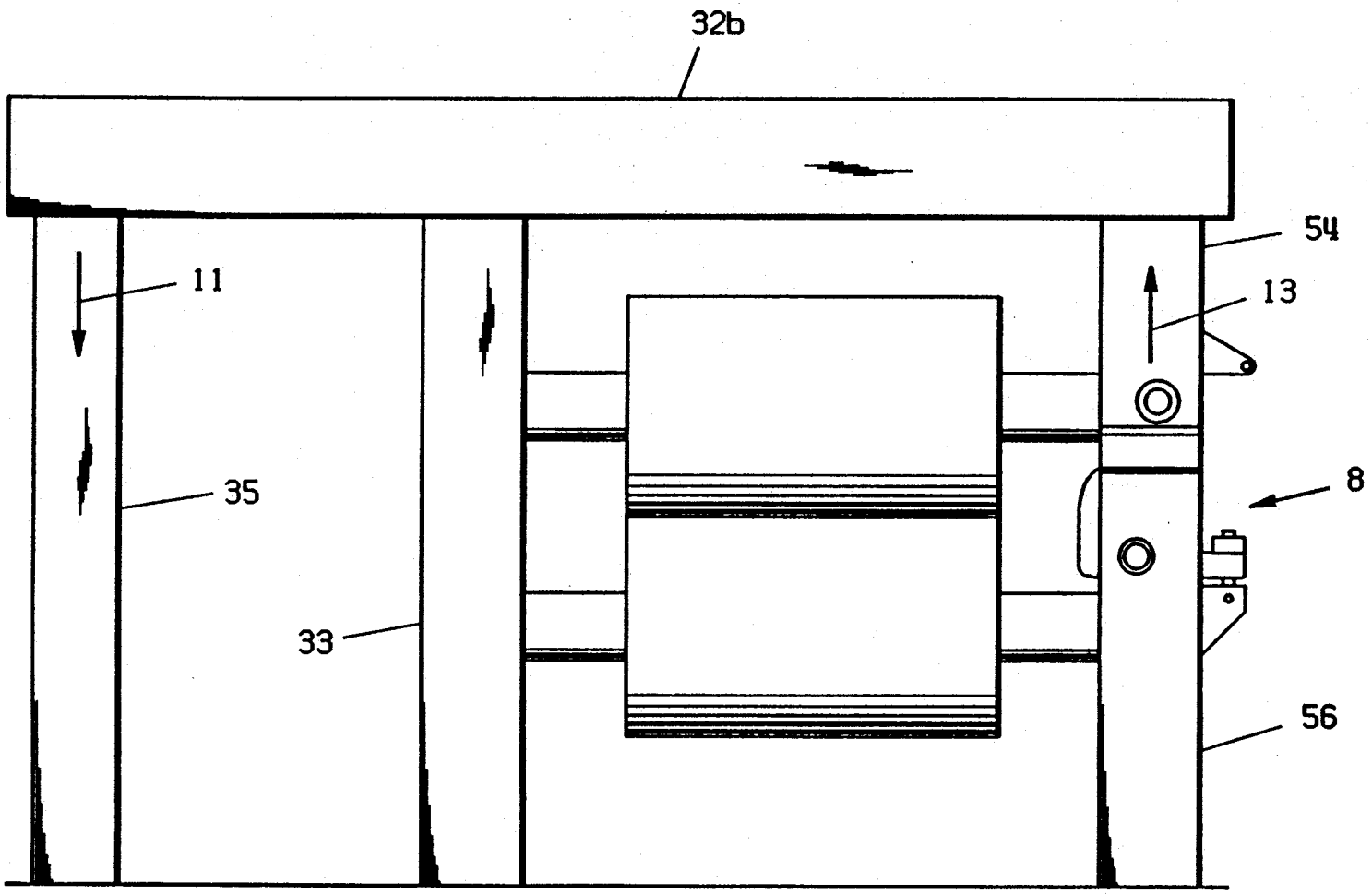
FIG. 5 is a side-elevational view of a cantilevered papermaking machine press framework including the quick-release apparatus of this invention.

Referring to FIG. 5, the quick-release post apparatus is shown somewhat schematically at 8. Arrows 11 and 13 illustrate how the upper beam **32*b* is cantilevered over rear beam 33 by beam 35 under tension. This permits upper beam 54 to be held, or even moved very slightly upwardly, as shown by directional arrow 13, so as to permit easy removal of the press felt, or blanket, when the quick-release post apparatus 8** is removed.

Thus, a quick-release post apparatus which achieves the objects, features and advantages set forth, as well as other objects, features and advantages, has been shown and described. Naturally, variations in the structure of the preferred embodiment will be readily available to those skilled in the art and are intended to be within the scope of the claims. For example, the pivot of the swing arm could be located above the rod in FIG. 4A so as to be between the rod and the link pivot.

What is claimed is:

1. In a papermaking machine press frame, a quick-release post apparatus for selectively establishing and releasing structural integrity in the press frame, the apparatus comprising, in combination:

first and second post members, each member having a load end, the load ends opposing each other and being spaced apart for receiving a block means to bear against the respective load ends when the post apparatus is operatively engaged;

a link having a proximate end movably mounted in the first post member, and a distal end having rod means, the link movable to selectively position the rod means from a position away from the second post member for establishing a gap between the post members to a position proximate the second post member for closing the gap between the load ends of the post members;

a swing arm pivotally mounted in the second post member, the swing arm including a lever, and a hook for engaging the rod means when the swing arm is pivoted from an open position away from the second post member to a closed position proximate the second post member;

securing means for selectively securing and releasing the lever from a secured position where the hook engages the rod to cause compressive engagement of the opposed load ends against the block means, and a non-secured position where the hook is disengaged from the rod means such that the block means can be removed from between the post member load ends.

2. A quick-release post apparatus as set forth in claim 1, wherein:

the hook includes a curved, rod-receiving load surface for compressively engaging the rod means thereagainst;

the rod-receiving load surface is offset from a substantially vertical plane through the swing arm pivot.

3. A quick-release post apparatus as set forth in claim 1, wherein:

the securing means includes eye bolts for selectively securing and releasing the lever from the second post member.

4. A quick-release post apparatus as set forth in claim 1, wherein:

the first post member includes a longitudinally extending slot through the load end with the link pivotally mounted within the slot;

the second post member includes a corresponding longitudinally extending slot through the load end for receiving the distal end of the link;

the swing arm is pivotally mounted such that its hook retains the rod means within the slot of the second post member.

5. A quick-release post apparatus as set forth in claim 1, wherein:

the link includes a counterweight for facilitating movement of the link from a disengaged position to an engaged position.

6. A quick-release post apparatus as set forth in claim 1, wherein:

the link engages the second post member only through the swing arm, the swing arm pivot pin and the securing means.

7. A quick-release post apparatus as set forth in claim 1, wherein:

the securing means extends between the lever and the second post member.

8. A quick-release post apparatus as set forth in claim 1, wherein:

the swing arm has a center of gravity located such that it moves a relatively short distance angularly about the swing arm pivot before the hook and rod are engaged or disengaged.

* * * * *